United States Patent [19]

Agatahama et al.

[11] Patent Number: 4,831,348

[45] Date of Patent: May 16, 1989

[54] LOW PROFILE ELECTROMAGNETIC RELAY TO PRINTED CIRCUIT BOARD

[75] Inventors: Shunichi Agatahama, Osaka; Hirofumi Koga; Ryuichi Sato, both of Kyoto; Hiroyuki Sagawa, Takatsuki; Kazushige Matsuoka, Kyoto, all of Japan

[73] Assignee: Omron Tateisi Electronics Co., Kyoto, Japan

[21] Appl. No.: 196,864

[22] Filed: May 23, 1988

Related U.S. Application Data

[63] Continuation of Ser. No. 75,228, Jul. 13, 1987, abandoned, which is a continuation of Ser. No. 871,387, Jun. 6, 1986, abandoned.

[30] Foreign Application Priority Data

Jun. 6, 1985 [JP] Japan ..... 60-123781

[51] Int. Cl.[4] ..... H01H 51/22

[52] U.S. Cl. ..... 335/80; 335/128

[58] Field of Search ..... 335/78–85, 335/121, 4, 5, 9, 130–133, 128, 203

[56] References Cited

U.S. PATENT DOCUMENTS 4,292,613 9/1981 Bando et al. ..... 335/106
4,437,078 3/1984 Bando et al. .
4,613,840 9/1986 Yabu et al. ..... 335/129

FOREIGN PATENT DOCUMENTS 0117451 9/1984 European Pat. Off. .
0204199 12/1986 European Pat. Off. .
2936101 3/1980 Fed. Rep. of Germany .

OTHER PUBLICATIONS

K. Matsuoka, a Miniature High Temperature Resisting Relay for Surface Mount, presented at the 34th Annual National Relay Conference at Oklahoma State University, Stillwater, OK, Apr. 21–23, 1986.

*Primary Examiner*—E. A. Goldberg
*Assistant Examiner*—L. Donovan
*Attorney, Agent, or Firm*—Wegner & Bretschneider

[57] ABSTRACT

This low profile electromagnetic relay includes a base and a support post protruding at one end of the base. An electromagnet assembly is mounted in a generally central position on the base, and has a pair of magnetic pole surfaces on opposite sides of its one end. An armature assembly includes an insulating armature member, shaped generally as a hollow rectangular member with an open space being defined within it and formed with a hole by which it is rotatably fitted over the support post with the electromagnet assembly fitting inside the open space defined within it. A drive portion is connected to the insulating armature member. A pair of mutually opposed armature pieces are mounted on the insulating armature member, and, when the insulating armature member is rotatably fitted over the support post, lie on opposite sides of the one end of the electromagnet assembly and each oppose one of the magnetic pole surfaces of the electromagnet assembly. A permanent magnet member is mounted so as to bridge between the pair of mutually opposed armature pieces. And a contact mechanism is fitted to the base and is driven by the drive portion of the insulating armature member. Thereby the height of the relay is minimized, and the stability of its action is assured.

3 Claims, 4 Drawing Sheets

FIG. 5
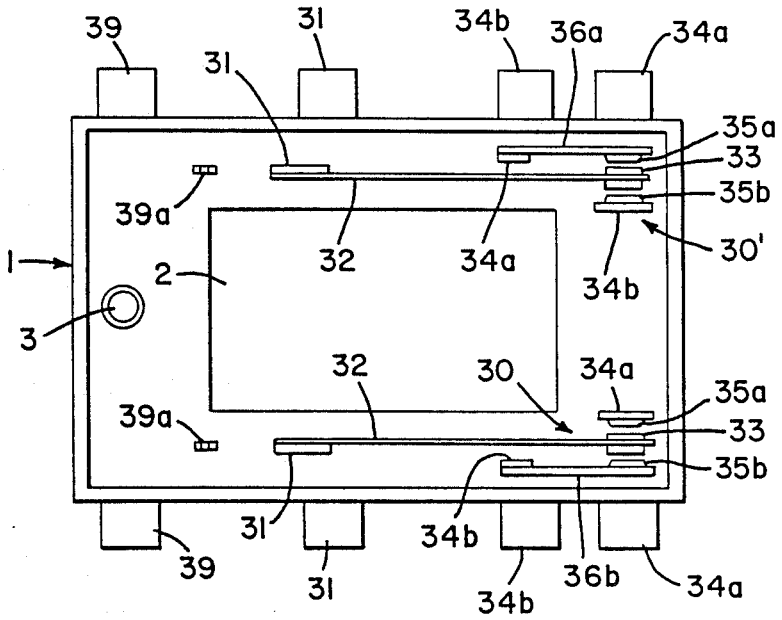
FIG. 6
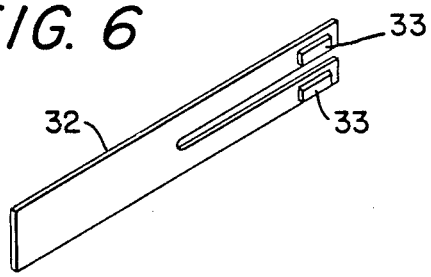
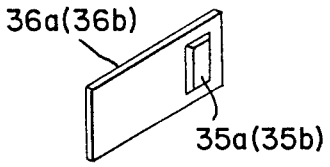
FIG. 7

LOW PROFILE ELECTROMAGNETIC RELAY TO PRINTED CIRCUIT BOARD

This application is a continuation of U.S. application Ser. No. 075,228, filed July 13, 1987, now abandoned, which is a continuation of Ser. No. 871,387, filed June 6, 1986, now abandoned.

BACKGROUND OF THE INVENTION

The present invention relates to an electromagnetic relay, and more particularly relates to a low profile type of electromagnetic relay which is particularly suitable for being mounted directly to a printed circuit board.

There are various conventional types of electromagnetic relays, and in the recent prior art various types of such electromagnetic relays have been proposed for being directly mounted to printed circuit boards. It is desirable that such a directly mounted electromagnetic relay should be low in height, so that it may be of approximately the same height as other components mounted on the printed circuit board; and such a relay should as a matter of course be accurate and stable in action. Particularly, with a directly mounted electromagnetic relay of the type categorized as a SMD (surface mounted device), the desirability of reduction of the overall height is very strong because its terminals are directly soldered to the printed circuit board. Further, because such a directly mounted electromagnetic relay will inevitably be directly exposed to heat from various components mounted on the printed circuit board, it is desirable that it should be able to tolerate quite high temperatures.

As a typical conventional electromagnetic relay adapted to be mounted on a printed circuit board, there is the one disclosed in Japanese Patent Laying Open Publication No. 57-30232. According to this prior art type of electromagnetic relay, since its contact drive element or armature member is located between the base and the driving electromagnet device, or in other words these elements are stacked one over the other, there arose the problem that the overall height of the relay tended to be greater than desired. Furthermore, since its contact drive element or armature member was planar, it had a tendency to warp as a result of temperature variations. Furthermore, the action of the contact drive element or armature member has a tendency not to be properly stable, due to the fact that the support shaft is rather short. These problems tended to contribute to the instability of the action of such a prior art electromagnetic relay.

SUMMARY OF THE INVENTION

Accordingly, it is the primary object of the present invention to provide a low profile electromagnetic relay, suitable for being mounted to a printed circuit board.

It is a further object of the present invention to provide such a low profile electromagnetic relay of the SMD type.

It is a further object of the present invention to provide such a low profile electromagnetic relay, which is suitable for having its terminals directly soldered to a printed circuit board on which it is mounted.

It is a further aspect of the present invention to provide such a low profile electromagnetic relay, which is able to withstand high temperatures and a great degree of temperature variation.

It is a further object of the present invention to provide such a low profile electromagnetic relay, of which no components are particularly prone to warpage.

It is a further object of the present invention to provide such a low profile electromagnetic relay, which has a stable action.

According to the most general aspect of the present invention, these and other objects are attained by a low profile electromagnetic relay, comprising: (a) a base; (b) a support post protruding at one end of said base; (c) a electromagnet assembly mounted in a generally central position on said base, and having a pair of magnetic pole surfaces on opposite sides of its one end; (d) an armature assembly, comprising: (d1) an insulating armature member, shaped generally as a hollow rectangular member with an open space being defined within it, formed with a hole by which said insulating armature member is rotatably fitted over said support post with said electromagnet assembly fitting inside said open space defined within said insulating armature member; (d2) a drive portion connected to said insulating armature member; (d3) a pair of mutually oppposed armature pieces mounted on said insulating armature member and, when said insulating armature member is rotatably fitted over said support post, being on opposite sides of said one end of aid electromagnetic assembly and each opposing one of said magnetic pole surfaces of said electromagnet assembly; and: (d4) a permanent magnet member mounted so as to bridge between said pair of mutually opposite armature pieces; and: (e) a contact mechanism fitted to said base and driven by said drive portion of said insulating armature member.

According to such a structure, since the insulating armature member is shaped generally as a hollow rectangular member with an open space being defined within it, and the armature assembly is constructed on the basis of said insulating armature member and serves for driving the contact mechanism, said insulating armature member surrounding the electromagnet assembly placed on the base and being rotatably mounted on the support post provided on the base, the overall height of the relay itself can be reduced. Furthermore, since the length of the support post may be selected to be comparable to the height of the electromagnetic assembly and since the insulating armature member is built as a frame body which is relatively resistant to temperature changes and its rigid, the action of the relay is stabilized and the opening and closing properties of the relay are improved. Additionally, since the drive point of the contact assembly by the insulating armature member may be freely selected within limits imposed by the construction, the action of the contact assembly can be even more stabilized.

Further, according to a particular specialization of the present invention, the above specified and other objects and more particularly attained by a low profile electromagnetic relay as specified above, wherein the plane of rotation of said insulating armature member is generally parallel to said base.

BRIEF DESCRIPTION OF THE DRAWINGS

The present invention will now be described with respect to the preferred embodiment, thereof, and with reference to the illustrative drawings appended hereto, which however are provided for the purposes of explanation and exemplification only, and are not intended to be limitative of the scope of the present invention in any way, since this scope is to be delimited solely by the accompanying claims. With relation to the figures, spatial terms are to be understood as referring only to the orientation on the drawing paper of the illustrations of the relevant parts, unless otherwise specified; like reference numerals, unless otherwise so specified, denote the same parts and gaps and spaces and so on in the various figures; and:

FIG. 5 is plan view of the base of the relay as shown by itself with certain contact mechanisms affixed thereto;

FIG. 6 is a perspective view of a movable contact member of the relay; and

FIG. 7 is a perspective view of an intermediate terminal member of said relay.

DESCRIPTION OF THE PREFERRED EMBODIMENT

Figure 1:
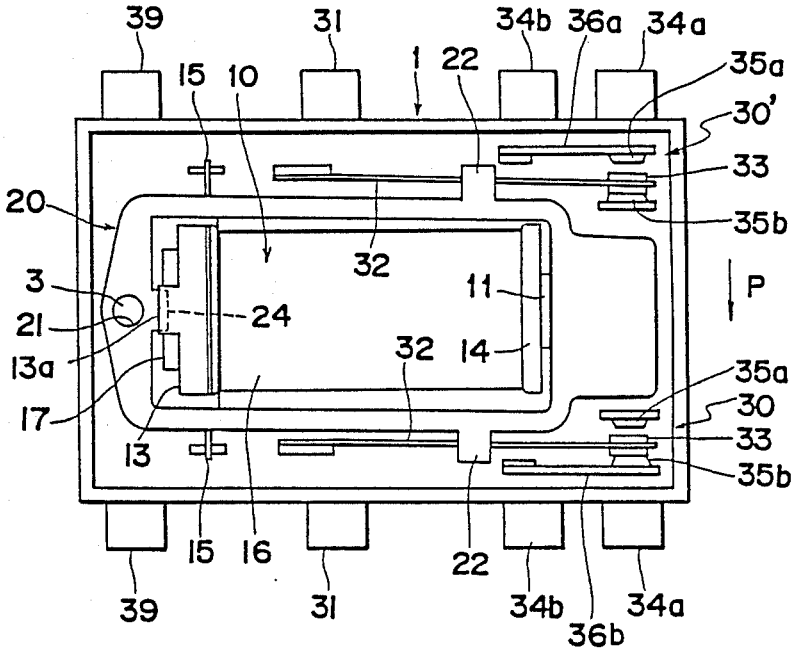
FIG. 1 is a plan view of the preferred embodiment of the relay of the present invention shown with its cover removed.

The present invention will now be described with reference to the preferred embodiment thereof, and with reference to the figures. The preferred embodiment of the relay of the present invention is shown in plan view in FIG. 1 and in exploded sectional view in FIG. 2; it comprises a main base member 1 which is formed with a depression 2 in its central portion, a yoke member 17 resting in said depression 2, an electromagnet assembly 10 fitted to said yoke member 17, an armature assembly 20 which is formed generally as a hollow rectangular assembly around said armature assembly 20 and said yoke member 17, and can move to and fro in a pivoting motion, contact mechanisms 30 and 30' fixed to the base member 1 and actuated by the pivoting movement of the armature assembly 20, and a cover 40.

In more detail, the electromagnet assembly 10 comprises a bar shaped iron core member 11 which is fitted with flanges 13 and 14 made of resin by insert molding, and a coil 16 is wound around said iron core member 11 between the flanges 13 and 14. The ends of the coil 16 are connected to intermediate coil terminals 5 which are fixedly secured to the flange 13 and extend upwards in hooked shapes. The yoke member 17 is formed with a central flat bar shaped portion, with a turned up end portion 18 located at one end of said central bar portion and formed with two vertically extending fork portions **18*b* flanking a slot 18*a*, and with, located at the other end of said central bar portion and at one side thereof, a turned up side portion 19*a*. And the electromagnet assembly 10 fitted onto said yoke member 17, with the coil 16 thereof fitting over the central bar portion of said yoke member 17, with the one end 11*a* of the iron core member 11 fitted as confronting the turned up side portion 17*a* of said yoke member 17 as will be explained shortly, and with the other end 11*b* (not shown in the drawings) of said iron core member 11 fitted into the slot 18*a* between the two fork portions 18*b* and either wedged therebetween by press forming said fork portions 18*b* inwards or fixed to them by laser welding. And the combination of the yoke member 17 and the electromagnet assembly 10 is fitted into the depression 2 of the base 1 and fixed therein, and then while in this position the ends of the two intermediate coil terminals 15 are soldered into notches 39*a* of two intermediate terminals 39 which are insert molded into the base 1 as will be particularly described hereinafter, so as to provide electrical connection from outside to the coil 16 of the electromagnet assembly 10**.

The armature assembly 20 is made up from an armature frame member **20*a*, two armature pieces 28*a* and 28*b* fitted thereto, and a magnet piece 29. In more detail, the armature frame member 20*a* is generally formed as a hollow rectangular member, and in one end of said hollow rectangular armature frame member 20*a* there is formed a vertically extending hole 21. A post member 3 is fixedly mounted on and extends vertically up from one end of the base 1, opposite the end 11*b* of the iron core member 11 of the electromagnet assembly 10, and the armature frame member 20*a* is pivotably fitted over said post member 3 by said hole 21, so as to be able to turn to and fro around said post member 3 to a certain extent in a plane generally parallel to the base member 1. To and vertically downwardly projecting from the under side of a projection portion 20*b* at the other end of the armature frame member 20*a* from the hole 21 there are fitted by insert molding the two armature pieces 28*a* and 28*b*, and the magnet piece 29 is laid against said under side of said projection portion 20*b* so as to bridge between said two armature pieces 28*a* and 28*b*. And on either side of this armature piece assembly, denoted by 50, there are provided projecting arm portions 22 which have downwardly facing slots 23 formed in them, for actuating contacts as will be described shortly. And, when fitted, this armature assembly 20 is prevented from coming off from the post member 3, by an inwardly extending projection 24 from the armature frame member 20*a* near the hole 21 thereof being fitted under an outwardly extending projection 13*a* from the flange 13 of the electromagnet assembly 10. Thus, in this fitted position, the armature frame member 20*a* substantially surrounds the electromagnet assembly 10 while being able to turn around the post member 3 through a certain limited and sufficient angle, and the two armature pieces 28*a* and 28*b* lie on opposite sides of the end 11*a* of the iron core 11 of said electromagnet assembly 10, on the opposite sides of which core member end 11*a* there are bondedly mounted magnetic shield plates 12*a* and 12*b*; in fact, the armature piece 28*b* lies between the magnetic shield plate 12*b* and the upwardly projecting turned up side portion 19*a* of the yoke member 17, and the magnet piece 29 lies on top of the end 11*a* of the iorn core member 11**.

The contact mechanisms 30 and 30' are located on opposite sides of the base 1, and, as best seen in the plan view of FIG. 5, each comprises: a fixed terminal 31 insert molded into the base 1; a springy member 32 one end of which is fixed to said fixed terminal 31 and which has a longitudinal slot (see FIG. 6) formed in its other end; contact pieces 33 fixed on both surfaces of said other end of said springy member 32; a fixed terminal 34a mounted to the base 1 by insert molding and extending to the outside and projecting inwardly to lie on the upper side in the figures of said other end of said springy member 32 and having a contact piece **35*a* mounted to its so as to oppose and to cooperate with the one of said contact pieces 33 mounted on the upper side of said springy member 32; another fixed terminal 34*b* mounted to the base 1 by insert molding and extending to the outside and projecting inwardly to lie on the lower side in the figures of said other end of said springy member 32; and a short member 36***a* or 36*b* fixed at its one end to said fixed terminal 34*a* on the upper side of the construction and to said fixed terminal 34*b* on the lower side of the construction and in either case extending along the outer side of said springy member 32 and having a contact piece 35*a* or 35*b* mounted on its inner side so as to oppose and to cooperate with the one of said contact piece 33 mounted on the outer side of said springy member 32. In this connection, in the contact mechanism 30', the fixed terminals 34*a* and 34*b* cross over one another without contacting, inside the resin material of the base 1; this is in order to maintain the same directional arrangement for these fixed terminals 34*a* and 34*b* in the two contact mechanisms 30 and 30'. And the slot 23 of each of the projecting portions 22 of the armature assembly 20 is engaged over the corresponding said springy member 32 so as, when said armature assembly 20 pivots on the post member 3, to drive said springy members 32 in the one direction or the other, thereby to engage the corresponding pairs of contact pieces 33 and 35 as will be easily understood based upon the above description and the figures.

Now, the process of assembling these contact mechanisms 30 and 30' into the base 1 will be described in the following.

Figure 3:
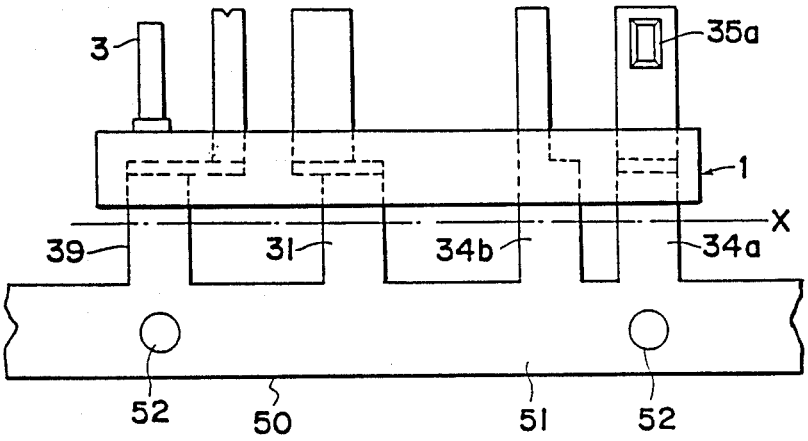
FIG. 3 is a front view showing the process of implanting terminals in the base of the relay of FIGS. 1 and 2, during the manufacture of the relay.
Figure 4:
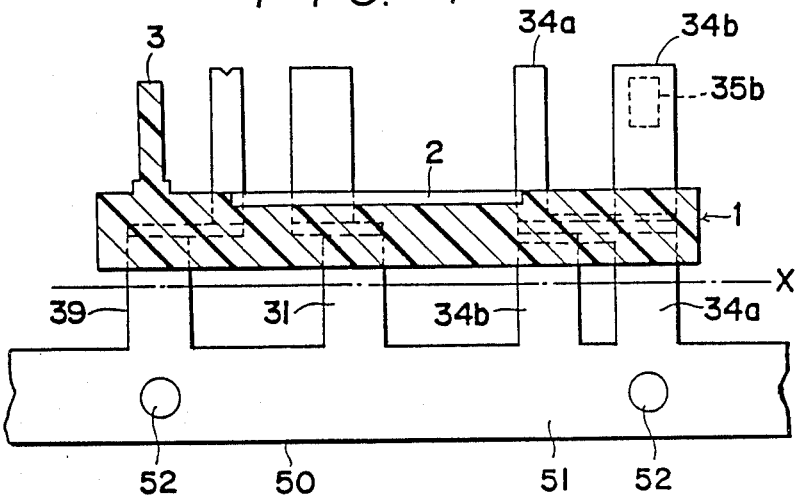
FIG. 4 is a sectional view through said base and said terminals, during said manufacture of the relay.

As shown in FIGS. 3 and 4, for each side of the relay, the terminals 31, 34*a*, and 34*b* as well as the coil terminals 39 are stamped out and bent from a hoop member or blank member 50, to the shapes desired, all being connected by the connecting piece 51 which has pilot holes 52 formed in it, and then they are insert molded into the base 1 during manufacture thereof. At this time, as mentioned above, it is arranged that the terminals 34*a* and 34*b* which constitute the contact mechanism 30' shown in the upper portions of FIGS. 1 and 5 cross one another in the base 1 without making contact with one another; this is in order to properly arrange the fixed terminals 34*a* and 34*b* for each contact mechanism.

Figure 2:
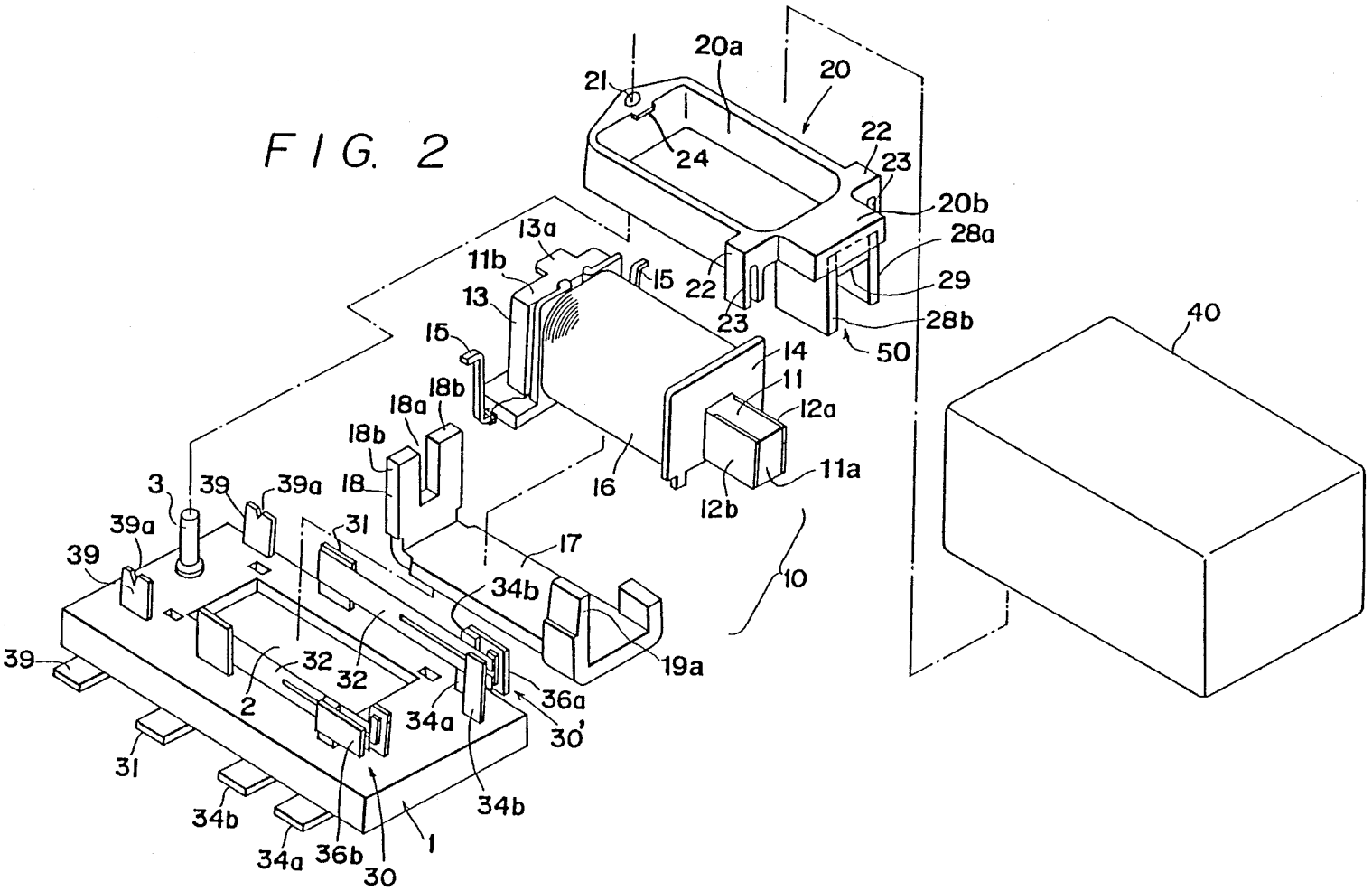
FIG. 2 is an exploded perspective view of said preferred embodiment relay.

Next, the connecting piece 51 of the blank 50 is cut away, and ther terminals 31, 34*a*, 34*b* and 39 are bent outward along the chain dot line "X", to extend sideways as shown in FIG. 2 so that the relay as a whole may be conveniently and satisfactorily mounted on the surface of a printed circuit board.

As shown in FIG. 5, each of the rear ends (left ends in that figure) of the springy members 32 is secured to the upper protruding portions of the terminals 31 by spot welding, crimping, or the like, so that each of the springy members 32 is securely and firmly supported by its terminal 31, with one of its contact pieces 33 opposing the contact piece 35*a* on the corresponding terminal 34*a*. Similarly, each of the short members 36a and 36*b* bearing its contact piece 35*a* or 35*b* is secured to the corresponding terminal 34*a* or 34*b* by spot welding or the like so that its contact piece 35*a* or 35*b* opposes the appropriate contact piece 33 on the end of the corresponding springy member 32. In this construction, the contact pieces 33, 35*a*, and 35*b* are fixedly secured on the respective ones of the springy members 32 and the terminals 34*a* and 34*b* and the short members 36*a* and 36*b*, before the insert molding process to insert these terminals into the base 1.

This relay functions as follows. If no actuating electrical energy is supplied via the terminals 39 to the coil 16, then the armature assembly 20 is rotated in the direction indicated by the arrow "P" in FIG. 1 by the magnetic force of the permanent magnet 29, so as to cause the armature piece 28*b* to contact the upwardly protruding portion 19*a* of the yoke member 17, and so as thereby to cause the contact mechanism 30 to be switched so as to contact its one contact piece 33 to the contact piece 35*b* of its short member 36*b* while removing its other contact piece 33 from the contact piece 35*a* of its terminal 34*a*, thereby connecting together its terminals 31 and 34*b* while isolating its terminal 34a; and the contact mechanism 30' is on the other hand switched so as to contact its one contact piece 33 to the contact piece 35*b* of its terminal 34*b* while removing its other contact piece 33 from the contact piece 35*a* of its short member 36*a*, thereby connecting together its terminals 31 and 34*b* while isolating its terminal 34*a*, as shown in FIG. 1. On the other hand, when actuating electrical energy is supplied in the appropriate electrical polarity via the terminals 39 to the coil 16, then the magnetic force induced in the yoke member 17 by said coil 16 creates "N" poles on the pole surfaces on the free end 11*a* of the iron core member 11 which repel the armature piece 28*a* while attracting the armature piece 28*b*, and this causes the armature assembly 20 to be rotated in the direction opposite to that one indicated by the arrow "P" in FIG. 1. so as to cause the armature piece 28*b* to be moved away from the upwardly protruding portion 19*a* of the yoke member 17 and to contact the plate 12*b* fitted on said end 11*a* of said iron core member 11, which causes the contact mechanism 30 to be switched so as to contact its one contact piece 33 to the contact piece 35*a* of its terminal 34*a* while removing its other contact piece 33 from the contact piece 35*b* of its short member 36*b*, thereby connecting together its terminals 31 and 34*a* while isolating its terminal 34*b*; and the contact mechanism 30' is on the other hand switched so as to contact its one contact piece 33 to the contact piece 35*a* of its short member 36*a* while removing is other contact piece 33 from the contact piece 35*b* of its terminal 34*b*, thereby connecting together its terminals 31 and 34b while isolating its terminal 34*a*. Further, when the supply of actuating electrical energy via the terminals 39 to the coil 16 is terminated, then the original switched condition of the relay is restored.

According to the construction of the present invention as described above, since the armature assembly 20 is so disposed as to surround the exterior of the electromagnet assembly 10 and to be switched by turning through a relatively small angle about the post member 3, the overall height of the relay away from the printed circuit board to which it is fitted is minimized, and the relay accordingly is well adapted to the other component parts that are fitted on the same printed circuit board. Additionally, the fact that the core 16 is wound directly onto the iron core member 11 contributes to the reduction of the height of the relay. Furthermore, since the armature assembly 20 is constructed on the basis of the armature frame member 20*a*, it has a relatively high rigidity, and the fact that the post member 3 can be made relatively long improves the stability of the action of the opening and closing of the relay. Yet further, since the contact pieces 33 and the intermediate terminals 31, 34*a* and 34*b* are mounted after the terminals are insert molded with the base 1, organic gases which may be produced in the course of resin molding are not prone to adhere to the contacts, and accordingly the reliability of the contacts is improved.

The electromagnet relay of the present invention is not limited to the above described embodiment but may be freely modified within the spirit of the present invention as defined by the appended claims. For instance, the relay may not necessarily of the type which restores itself when the coil 16 is demagnetized but may also be the self holding type which holds its state with a permanent magnet, given the appropriate modifications. Only one of the contact mechanisms 30 and 30' may be provided to the relay, instead of two as in the shown preferred embodiment. Furthermore, the fixed contact 35*a* of the contact mechanism 30' may be attached to the base 1 after the terminals 34*a* and 34*b* are insert molded with the base 1, as a modification.

Thus, as described above, according to the present invention, since the armature assembly 20 constructed on the basis of the armature frame member 20 which serves for driving contacts is shaped as a hollow rectangular member so as to surround the electromagnet assembly 10 placed on the base 1 and is rotatably mounted on the support post 3 provided on the base 1 at its other end, the overall height of the relay itself can be reduced. Furthermore, since the length of the support post 3 may be selected to be comparable to the height of the electromagnet assembly 10 and the armature frame member 20 is built as a frame body which is relatively resistant to temperature changes and is rigid, the action of the relay is stabilized and the opening and closing properties of the relay is improved. Additionally, since the drive points of the movable contacts by the armature frame member 20 the may be selected anywhere along the longitudinal direction of the springy members 32, the action of the contacts may be even more stabilized by selecting them appropiately adjacent to centers of the attractive forces of the electromagnet assembly 10.

Although the present invention has been shown and described in terms of the preferred embodiment thereof, and with reference to the appended drawings, it should not be considered as being particularly limited thereby, since the details of any particular embodiment, or of the drawings, could be varied without, in many cases, departing from the ambit of the present invention. Accordingly, the scope of the present invention is to be considered as being delimited, not by any particular perhaps entirely fortuitous details of the disclosed preferred embodiment, or of the drawings, but solely by the scope of the accompanying claims, which follow.

What is claimed is:

1. A low profile electromagnet relay, comprising:

(a) a base;

(b) a support post protruding from one end of said base;

(c) an electromagnetic assembly mounted in a generally central position on said base, said electromagnetic assembly having a coil and having an iron core member with a pair of magnetic pole surfaces on opposite ends of one end thereof;

(d) an armature assembly, comprising:

(d1) an insulating armature member, shaped generally as a hollow rectangular, member with an open space defined therein, said insulating armature member having a hole by which said insulating armature member is rotatably fitted over said support post, so that, when said coil is energized, said insulating armature member pivots about an axis perpendicular to the longitudinal axis of said iron core member, said electromagnet assembly fitting inside said open space defined within said insulating armature member, so that said insulating armature member is disposed around said coil;

(d2) a drive portion connected to said insulating armature member;

(d3) a pair of mutually opposed armature pieces mounted on one end of said insulating armature member and, when said insulating armature member is rotatably fitted over said support post, being on opposite sides of said one side of said iron core member and each opposing one of said magnetic pole surfaces; and (d4) a permanent magnet member mounted so as to bridge between said pair of mutually opposed armature pieces; and (e) a contact mechanism fitted to said base and driven by said drive portion of said insulating armature member.

2. A low profile electromagnetic relay according to claim 1, wherein the plane of rotation of said insulating armature member is generally parallel to said base.

3. A low profile electromagnetic relay according to claim 1, wherein the resulting height of said insulating armature member and said coil are arranged so as to be no greater than the height of said coil alone.

* * * * *